United States Patent [19]

Yasuda et al.

[11] Patent Number: 4,624,545

[45] Date of Patent: Nov. 25, 1986

[54] DEVELOPING DEVICE WITH REGULATED DEVELOPER SUPPLY

[75] Inventors: Wataru Yasuda, Yokohama; Koji Sakamoto; Toshio Kaneko, both of Tokyo; Fuchio Kanno, Yokohama, all of Japan

[73] Assignee: Ricoh Company, Ltd., Tokyo, Japan

[21] Appl. No.: 542,034

[22] Filed: Oct. 14, 1983

[30] Foreign Application Priority Data

Oct. 15, 1982 [JP] Japan ..... 57-179900
Dec. 10, 1982 [JP] Japan ..... 57-186003[U]

[51] Int. Cl.[4] ..... G03G 15/09
[52] U.S. Cl. ..... 355/3 DD; 118/657
[58] Field of Search ..... 355/3 DD, 14 D; 118/657, 658

[56] References Cited

U.S. PATENT DOCUMENTS

| | | | |
|---|---|---|---|
| 4,373,798 | 2/1983 | Tsukada et al. | 355/3 DD |
| 4,395,110 | 7/1983 | Hosono et al. | 118/657 X |
| 4,406,535 | 9/1983 | Sakamoto et al. | 355/3 DD |
| 4,410,259 | 10/1983 | Yamagata et al. | 355/3 DD |
| 4,425,382 | 1/1984 | Tajima | 355/3 DD X |
| 4,458,627 | 7/1984 | Hosono et al. | 118/658 X |
| 4,538,898 | 9/1985 | Kanno et al. | 355/3 DD |

FOREIGN PATENT DOCUMENTS

| | | | |
|---|---|---|---|
| 0051848 | 4/1979 | Japan | 355/3 DD |
| 0115061 | 9/1980 | Japan | 355/3 DD |
| 0115065 | 9/1980 | Japan | 118/658 |

*Primary Examiner*—Arthur T. Grimley
*Assistant Examiner*—J. Pendegrass
*Attorney, Agent, or Firm*—Cooper, Dunham, Griffin & Moran

[57] ABSTRACT

A device is provided for developing an electrostatic latent image formed on an image bearing member with a developer comprised of magnetically attractable, electrically insulating toner particles for developing the latent image by applying the toner particles in the form of a thin film uniform in charge and thickness. The developing device generally comprises a developing sleeve, which is driven to rotate to carry thereon toner particles, and a pressure plate is held in pressure contact with the sleeve to thereby form a thin film of charged toner particles on the sleeve upstream of the developing station. In one aspect of the present invention, the pressure plate has a low hardness or relatively easily wearable region which is in pressure contact with the sleeve so as to prevent toner particles from permanently sticking to the pressure plate. In another aspect, the pressure plate is structured to have a locally defined relatively easily deflectable region which is in pressure contact with the sleeve. In a further aspect, the pressure plate is movable with respect to the sleeve to thereby remove stuck toner particles from the pressure plate and from the sleeve. In a still further aspect, a separator strip is provided, interposed between the pressure plate and the sleeve, which also keeps toner particles from sticking to the pressure plate. In a still further aspect, a cleaner is provided for cleaning the pressure plate periodically or continuously in order to keep toner particles from sticking to the pressure plate and to allow a thin film of uniformly charged toner particles to be formed on the sleeve for use in developing the latent image at the developing station.

5 Claims, 35 Drawing Figures

DEVELOPING DEVICE WITH REGULATED DEVELOPER SUPPLY

BACKGROUND OF THE INVENTION

1. Field of the Invention

This invention generally relates to a device for developing an electrostatic latent image formed on an image carrying member to convert it into a visible image. More particularly, the present invention relates to a developing device which uses a magnetically attractable developer for developing an electrostatic latent image whereby a thin film of uniformly charged developer is formed on a developer carrier prior to the application of the developer to the latent image at a developing station. More specifically, the present invention relates to a developing device using the so-called single component toner, which is particularly suited for use in an imaging machine such as an electrophotographic copying machine.

2. Description of the Prior Art

In various types of imaging machines, such as electrophotographic copiers, electrostatic recording machines and laser printers, a developing device is normally provided to develop a latent image formed on an image carrier, such as a photosensitive member, thereby converting the latent image into a visible image. In general, there are two categories of developing devices for use in such imaging machines: one category uses magnetically attractable toner, or often referred to as "single-component developer", and the other category uses the so-called two-component developer comprised of a mixture of toner particles and carrier beads. In either category of developing devices, usually the formation of a thin film of developer is desired or required before application to a latent image for its visualization. Particularly, in the case of a developing device utilizing a single-component developer comprised of magnetically attractable, electrically resistive toner particles, the developer is required to be forcibly changed to a predetermined polarity and level uniformly, and it is important that a thin film of developer may be formed as a preparation for application to a latent image to be developed.

In forming a thin film of uniformly charged toner particles on the surface of a developer carrier, which is driven to advance through a developing station where a latent image on an image carrier is developed with the application of the toner particles, it has been proposed to employ a pressure plate comprised of a resilient blade or a magnetic material and disposed with its free end portion in pressure contact with the surface of the developer carrier so as to form a thin toner film having a desired thickness and uniform charge due to frictional charging at the contact between the developer carrier and the pressure plate. Since the thickness of resulting thin toner film depends upon the contact condition between the developer carrier and the pressure plate, the surface condition of the pressure plate in contact with the developer carrier is vitally important, especially for securing a non-variant film forming performance for a long period of time.

FIG. 1*a* schematically illustrates a typical prior art developing device which utilizes magnetically attractable, electrically insulating toner particles as a developer, and it comprises a developing sleeve 2 which is driven to rotate in the direction indicated by the arrow and which transports toner particles 1 as carried on its peripheral surface as magnetically attracted thereto by means of a multi-pole magnet disposed inside of the sleeve and driven to rotate in the direction indicated by the arrow. Also provided is a pressure plate 3 whose free end portion is pressed against the peripheral surface of the developing sleeve 2. Thus, as the sleeve 2 is driven to rotate in the direction indicated by the arrow, the toner particles 1 attracted to the peripheral surface of sleeve 2 become compressed between the sleeve 2 and the pressure plate 3 at a point P thereby allowing to form a thin film of uniformly charged toner particles. However, after this arrangement is used for a relatively long period of time, the toner particles 1 tend to accumulate at an entrance section $P_1$ and an exit section $P_2$ fore and aft of the contact line P between the sleeve 2 and the plate 3. Under this condition, the accumulated toner particles tend to stick to the surface of the pressure plate 3 as shown in FIG. 1*b*. In the case of the developing device shown in FIG. 1*a*, since the tip end of plate 3 extends further downward from the contact line P between the sleeve 2 and the plate 3, there is formed a pair of stuck toner ridges 1*a* and 1*b* on the plate 3 fore and aft of the contact line P, as shown in FIG. 1*b*. It is thus quite important from a practical viewpoint to devise a structure which would help prevent the formation of such stuck toner ridges and keep the surface of the pressure plate as smooth as possible at all times.

SUMMARY OF THE INVENTION

The disadvantages of the prior art are overcome with the present invention and a developing device having a novel structure is hereby provided.

Therefore, it is a primary object of the present invention to provide an improved developing device.

Another object of the present invention is to provide an improved dry-type developing device which is stable in operation.

A further object of the present invention is to provide an improved developing device which utilizes magnetically attractable, electrically insulating toner particles as a developer.

A still further object of the present invention is to provide a single-component developer type developing device having a structure which allows to obtain a thin film of uniformly charged toner particles having a predetermined thickness without irregularities even after a relatively long period of use.

A still further object of the present invention is to provide a developing device compact in size and excellent in performance, useful in a compact imaging machine.

A still further object of the present invention is to provide a developing device particularly suited for use in developing an electrostatic latent image formed in an imaging apparatus, such as electrophotographic copiers, electrostatic recorders and laser printers.

Other objects, advantages and novel features of the present invention will become apparent from the following detailed description of the invention when considered in conjunction with the accompanying drawings.

DESCRIPTION OF THE PREFERRED EMBODIMENTS

Figure 2:
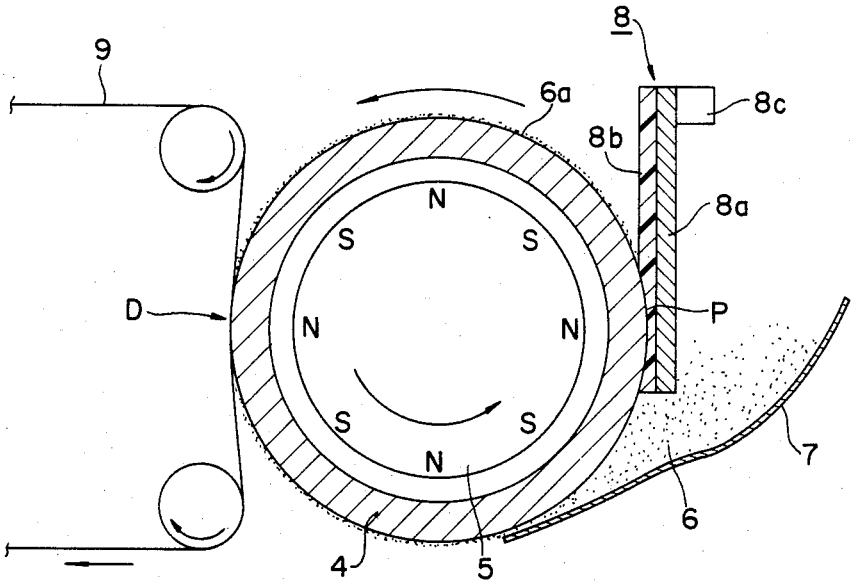
FIG. 2 is a schematic illustration showing a developing device constructed in accordance with one embodiment of the present invention and having a composite pressure plate.

Referring now to FIG. 2, there is shown a developing device employing a single-component developer for developing an electrostatic latent image constructed in accordance with one embodiment of the present invention when applied to an electrophotographic copying machine. As shown, the developing device comprises a cylindrical developing sleeve 4 of stainless steel or the like, which is rotatably supported by a housing (not shown) and rotates in the direction indicated by the arrow when driven, to cause developer to be transported in a circular path as carried on its peripheral surface. Inside of the sleeve 4 is disposed a multi-pole magnet roll 5 rotataly and coaxially with the sleeve 4. In the illustrated embodiment, the magnet roll 5 is driven to rotate in the same direction as that of the sleeve 4, and, as an example, the sleeve 4 is driven to rotate approximately at 500 mm/sec in peripheral speed with the magnet roll 5 driven to rotate approximately at 1,800 r.p.m., though the present invention should not be limited only to this.

Disposed to the right of the developing sleeve 4 is a hopper 7 containing therein a quantity of developer 6 which is, in the present example, comprised of magnetically attractable, electrically insulating toner particles. The magnetic toner particles 6 are supplied to the peripheral surface of the sleeve 4 under gravity. The magnetic toner particles 6 in the present example are mainly comprised of a resin and magnetic powder dispersed in the resin and have an average diameter of approximately 6 microns and true specific weight of 1.86. Thus, the magnetic toner particles 6 are magnetically attractable and electrically insulating in nature and they are often referred to as single-component developer.

Generally above the hopper 7 is disposed a pressure plate 8 depending downwardly, with its free end or bottom portion in pressure contact with the peripheral surface of the sleeve 4. It is to be noted that the pressure plate 8 is substantially as long as the sleeve 4 in its longitudinal direction, so that the pressure plate 8 is in contact with the sleeve 4 substantially across its full width. Of importance, the pressure plate 8 is a composite pressure plate having a multi-layer structure, two layer in the illustrated embodiment. The two-layer pressure plate 8 includes a backing layer 8*a* of a magnetic material having a sufficient resiliency as well as a stiffness, such as a SK material, and a contact layer 8*b*, fixedly provided as attached to the front surface of backing layer 8*a*, of a relatively soft and easily wearable material, such as a "Metaflon" SF plating (manufactured by Hikifune Corporation). The two-layer pressure plate 8 includes a supporting structure 8*c* which supports the pressure plate 8 at its top.

With such a structure, the two-layer pressure plate 8 is attracted toward the developing sleeve 4 due to magnetic attraction between the magnet roll 5 and the magnetic backing layer 8*a* so that the contact layer 8*b* becomes pressed against the peripheral surface of the sleeve 4. Under the condition, when the sleeve 4 is driven to rotate in the direction indicated by the arrow, the toner particles 6 supplied to the peripheral surface of the sleeve 4 from the hopper 7 as magnetically attracted thereto are caused to move past the pressure contact region between the sleeve 4 and the pressure plate 8 whereby the toner particles are formed into a thin film 6*a* having a desired thickness and uniform charge. It is to be noted that the pressure plate 8 has a two-layer structure, disposed with its contact layer 8*b* facing the developing sleeve 4. Since the contact layer 8*b* is comprised of a material which is relatively soft and wearable, accumulation and sticking of toner particles to the pressure plate 8 are advantageously prevented from occurring.

Of course, the composite pressure plate 8 of the present invention should not be limited only to a two-layer structure as described above and it may have a multiple layer structure of three or more layers. In any case, the contact layer which is defined by the front layer facing the sleeve 4 must be comprised of a material which is relatively easily wearable. It should also be noted that the supporting structure 8*c* may be structured to keep the pressure plate 8 pressed against the sleeve 4 when mounted. In such a case, the backing layer 8*a* may be made of a non-magnetic material because it would not need to rely on magnetic attraction.

As shown in FIG. 2, a photosensitive belt 9 is disposed on the opposite side of the pressure plate 8 with respect to the developing sleeve 4. A developing station D is defined between the photosensitive belt 9 and the developing sleeve 4, where an electrostatic latent image formed on the surface of the photosensitive belt 9 is developed with the selective application of toner particles in accordance with the charge pattern of latent image. It is to be noted that the belt 9 may be either in contact with or separated away over a small gap from the sleeve 4 at the developing station D. Thus, as the sleeve 4 rotates, the toner particles 6 attracted to the peripheral surface of the sleeve 4 are charged and formed into a thin film having a predetermined thickness when passed through the contact between the pressure plate 8 and the sleeve 4, and then the thus formed film of charged toner particles is applied to develop an electrostatic latent image formed on the photosensitive belt 9, for example, by any of electrophotographic image forming processes well known to those skilled in the art at the developing station D where the toner particles forming the film 6*a* are selectively transferred to the belt 9 as electrically attracted by the charge forming the latent image on the belt 9. Thereafter, the residual toner particles on the sleeve 4 are transported back to the toner supply region of the hopper 7 as the sleeve 4 further rotates.

Figure 3:
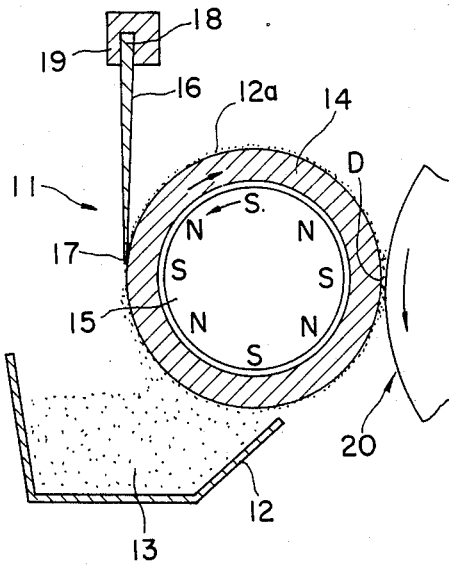
FIG. 3 is a schematic illustration showing a developing device constructed in accordance with another embodiment of the present invention and having a wedge-shaped pressure plate.

FIG. 3 illustrates a developing device 11 constructed in accordance with another embodiment of the present invention and including a pressure plate having a variable spring constant in the direction from its supporting point to its free end so as to form a thin film of uniformly charged toner particles. As shown, the developing device 11 includes a tank 12 containing therein a quantity of toner particles 13, which are magnetically attractable and electrically insulating in nature and have volume resistivity of $10^{10}$ ohms-cm or more, or preferably $10^{11}$ to $10^{13}$ ohms-cm or more. The developing device 11 also includes a rotatably supported developing sleeve 14 which is disposed generally above the tank 12 and driven to rotate in the direction indicated by the arrow during operation. It should be noted, however, that the sleeve 14 may be held stationary or motionless, if desired. Inside the sleeve 14 is disposed a multi-pole magnetic roll 15 having a plurality of poles arranged around the periphery of the roll 15 alternately in polarity at an equal interval. In the present embodiment, the magnet roll 15 is rotatably supported and it is driven to rotate in the direction indicated by the arrow. It is to be noted that the counterclockwise rotation of the magnet roll 15 as indicated in FIG. 3 causes the toner particles to move along the peripheral surface of the sleeve 14 in the clockwise direction irrespective of whether the sleeve 14 as a toner carrier is rotated or not unless the sleeve 14 is driven to rotate counterclockwise extremely fast.

The developing device 11 also includes a pressure plate 16 having its top end 18 connected to a supporting structure 19 which is, for example, a part of housing (not shown) of the developing device 11 and its free or bottom end 17 pressed against the peripheral surface of the sleeve 14. The pressure plate 16 is comprised of a magnetic material and it has enough resiliency so that it may at least partly deflect as attracted by the magnet roll 15 to form a pressure contact with the sleeve 14. The pressure plate 16 is substantially as long as the width of the sleeve 14. In the illustrated example, the top end 18 of the pressure plate 16 is fixedly held by the supporting structure 19. As will be discussed more in detail later, the pressure plate 16 has a particular structure which enables it to form a thin film of uniformly charged particles on the developing sleeve 14 even if the magnetic field strength in the vicinity of the pressure plate 16 varies.

During copying operation, the developing sleeve 14 is driven to rotate clockwise and the magnet roll 15 is driven to rotate counterclockwise so that the toner particles 13 attracted to the sleeve 14 from the tank 12 are transported clockwise along a circular path defined by the peripheral surface of the sleeve 14 and move past the contact line between the sleeve 14 and the pressure plate 16. It is to be noted that the magnet roll 15 may be driven to rotate in either direction as long as the sleeve 14 is driven to rotate clockwise at a speed above a certain critical level. Since the pressure plate 16 is comprised of a magnetic material at least partly, its free or bottom end portion becomes attracted and pressed against the sleeve 14. For this reason, the toner particles attracted to the sleeve 14 are pressed while moving past the contact region between the sleeve 14 and the pressure plate 16 thereby forming a thin film 12*a* of uniformly charged toner particles. As described before, the pressure plate 16 may be disposed with its free end 17 pressed against the sleeve when mounted to the supporting structure 19, or alternatively, the pressure plate 16 may be disposed such that its free end 17 becomes pressed against the sleeve 14 solely due to the magnetic attractive force exerted by the magnet roll 15.

The thus formed thin film 12*a* of uniformly charged toner particles is transported clockwise as carried on the sleeve 14 to the developing station D where a photosensitive member 20 bearing thereon an electrostatic latent image passes. Thus, the toner particles forming the thin film 12*a* are selectively transferred to the photosensitive member 20 as electrically attracted in accordance with a charge pattern defined by the latent image. Since the toner particles 13 are electrically highly insulating in nature, they become triboelectrically charged to a predetermined polarity when scrubbed at the pressure contact region between the sleeve 14 and the pressure plate 16. In this case, the toner particles forming the thin film 12*a* may be charged uniformly because the film 12*a* is formed to be relatively thin.

Figure 4A:
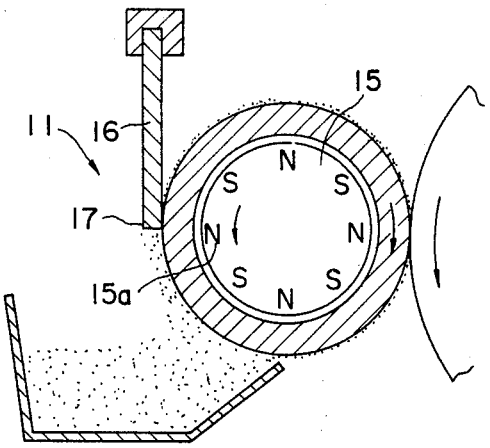
FIGS. 4*a* through 5*b* are schematic illustrations showing several forms of prior art developing devices which are useful for explaining the advantages of the present invention.
Figure 4B:
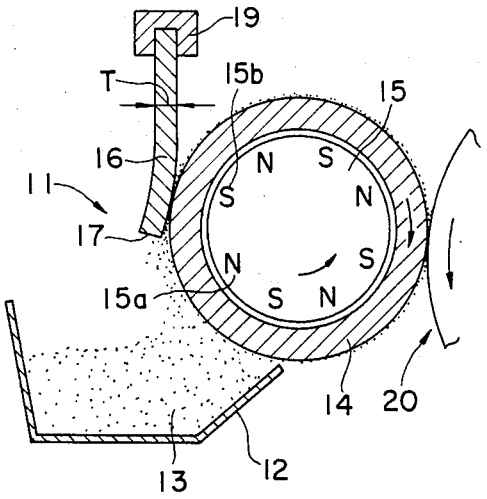
Figure 16:
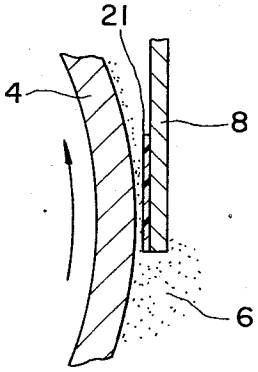
FIG. 16 is a still further embodiment of the present developing device which includes a wiping member provided as interposed between a sleeve 4 and a pressure plate 8.

In the embodiment illustrated in FIG. 3, the magnetic field strength in the vicinity of the free end 17 of pressure plate 16 varies periodically due to the counterclockwise rotation of the magnet roll 15. In view of this, the pressure plate 16 shown in FIG. 16 is constructed to have a wedge shape in cross section. The reason for making a wedge-shaped pressure plate which is thus convergent toward its tip end 17 will be described with reference to FIGS. 4*a* through 5*b*. The developing device shown in FIGS. 4*a* and 4*b* is structurally similar to the developing device shown in FIG. 3 excepting that the pressure plate 16 of the developing device 11 shown in FIGS. 4*a* and 4*b* is relatively thick and uniform in thickness, as indicated by T. As shown in FIG. 4*a*, when the magnet roll 15 takes the position with its one magnetic pole, or N polarity pole in this case, located directly opposite to the tip end 17 of the pressure plate 16, the tip end 17 is strongly attracted toward the magnet roll 15 and thus the tip end 17 becomes pressed against the sleeve 14 relatively strongly. On the other hand, when the magnet roll 15 rotates and the tip end 17 of the pressure plate 16 comes to be located inbetween the two adjacent poles N and S as shown in FIG. 4*b*, the bottom portion of the pressure plate 16 becomes warped because that portion of the pressure plate 16 that is directly opposite to the magnetic pole 15, or pole S in this case, receives the strongest magnetic attractive force. In this instance, the tip end 17 of the pressure plate 16 is moved away from the sleeve 14 due to local warping at its bottom portion. Then, a further rotation of the magnet roll 15 will reestablish the condition shown in FIG. 4*a* whereby the tip end 17 becomes again strongly pressed against the sleeve 14. The tip end 17 of the pressure plate 16 moves in repetition as described above as the magnet roll 15 is driven to rotate, so that the pressure plate 16 is set in vibration.

Figure 5A:
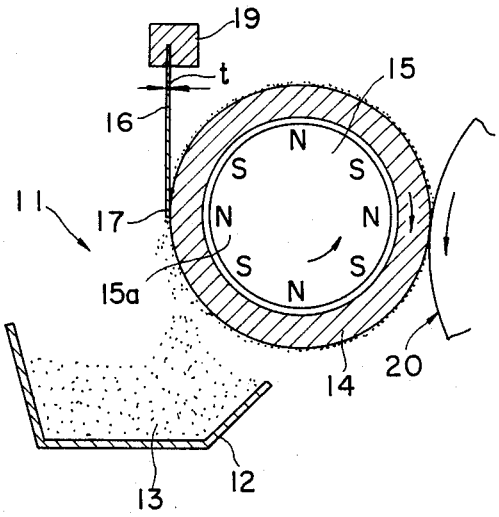
Figure 5B:
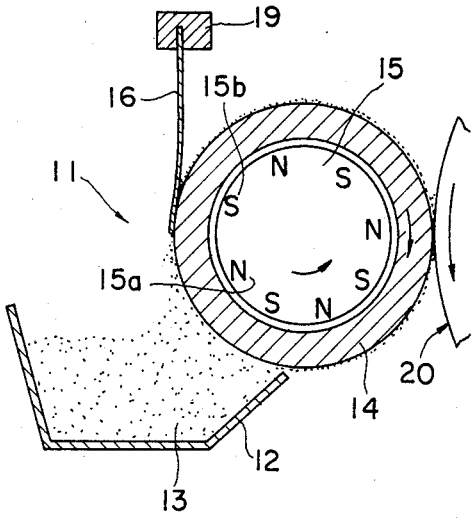

FIGS. 5*a* and 5*b* illustrate another developing device which is structurally similar to the previously described developing device 11 shown in FIGS. 4*a* and 4*b* excepting that the pressure plate 16 of the developing device 11 of FIGS. 5*a* and 5*b* has thickness t which is thinner than thickness T in the developing device of FIGS. 4*a* and 4*b*. In this case, as shown in FIG. 5*a*, when the magnet roll 15 has its one magnetic pole 15*a*, or N pole in this case, located directly opposite to the tip end 17 of the pressure plate 16, the pressure plate 16 takes the position similar to that shown in FIG. 4*a*. However, when the magnet roll 15 rotates and takes the position with the tip end 17 located between the two adjacent magnetic poles 15*a* and 15*b*, as shown in FIG. 5*b*, a certain length of the pressure plate 16 from its tip end 17 comes to be brought into contact with the sleeve 14 because the thin pressure plate 16 deflects relatively easily. In this instance, the tip end 17 of the pressure plate 16 is not separated away from the peripheral surface of the sleeve 14 because the pressure plate 16 deflects sufficiently.

As described above, the pressure plate 16 having a uniform thickness, whether thick or thin, can be a cause of unstability in forming a thin film of toner particles. Stated another way, it is not advantageous for the pressure plate 16 to have a uniform spring constant because it can be a source of generating irregularities in thickness and charge in the resulting thin film of toner particles. In order to cope with this, in the developing device embodying the present invention shown in FIG. 3, the pressure plate 16 is structured to have a wedge shape in cross section, or convergent from its supporting end 18 to its free end 17. With such a structure, even if the pressure plate 16 is made of the same material, the thickness becomes thinner toward its tip end 17, the easily deflectable portion may be limited only to the vicinity of the tip end 17. Thus, even if the magnet roll 15 rotates and the magnetic field intensity varies in the vicinity of the tip end 17 of the pressure plate 16, the tip end 17 may be prevented from being moved away from the sleeve 14 and at the same time the length of the pressure plate being deflected due to variation in magnetic field strength caused by the rotation of the magnet roll 15 may be limited. As a result, the thin film 12*a* of toner particles uniform in thickness as well as in charge may be formed stably at all times.

Experiments have been conducted using the developing device having the structure shown in FIG. 3 with the pressure plate 16, comprised of an SK material and having thickness of 0.1 mm at its tip end 17 and 0.2 mm at its supporting end 18, the developing sleeve 14 having surface roughness of 10 microns at maximum and the magnet roll 15 having eight magnetic poles arranged alternately in polarity around its periphery and producing the maximum magnetic flux density of 1,000 Gausses at the surface of the sleeve 14. The developer used comprised toner particles having average diameter of 6 microns and each containing a resin 50% by weight and $Fe_3O_4$ 50% by weight. Under the condition, it has been confirmed that the contact line pressure between the pressure plate 16 and the sleeve 14 is 3–8 gw/cm and the thin film 12*a* of toner particles formed on the sleeve 14 has an amount of deposition of 0.3–0.5 mg/cm$^2$, which may be advantageously used in developing an electrostatic latent image.

As described above, in accordance with the principle of the present invention, the pressure plate 16 to be used in the developing device 11 is so structured that its tip end portion is formed to be deflectable relatively easily as compared with the rest. In the illustrated embodiment of FIG. 3, the pressure plate 16 is structured to have different thickness from its supporting end 18 to its tip end 17, or convergent toward the tip end 17 in accordance with the present invention. However, in order to attain the objectives of the present invention, it is not always necessary to vary the thickness, but it is only necessary that the pressure plate 16 has a relatively easily deflectable portion at its tip end portion. For example, the pressure plate 16 may be so structured that it has a relatively easily deflectable portion, or a portion having a smaller spring constant, at its tip end as compared with the rest having a larger spring constant even if it has a uniform thickness. In this example, the pressure plate 16 is preferably so structured that its spring constant becomes smaller gradually toward the tip end 17. It is also possible to structure the pressure plate 16 such that thickness as well as spring constant vary from the supporting end 18 to the tip end 17 at the same time.

Figure 6:
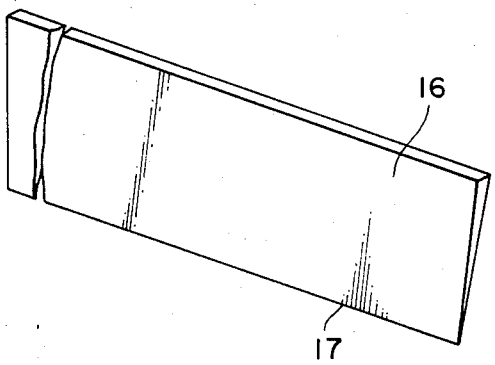
FIGS. 6 and 7 are perspective views showing two examples of pressure plate which may be advantageously applied to the present developing device.
Figure 7:
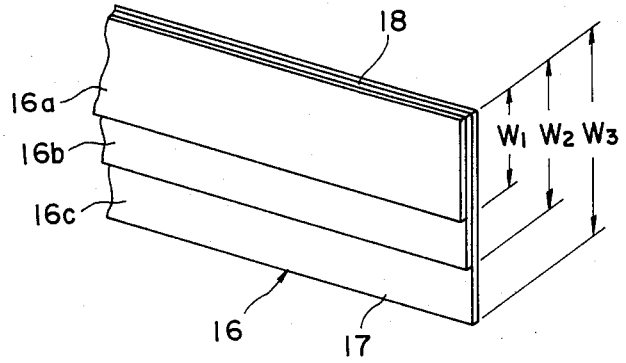

FIG. 6 illustrates one embodiment of the pressure plate 16 having a wedge-shaped cross section, which may be advantageously applied to the developing device 11. Such a wedge-shaped pressure plate 16 may be fabricated by severing a wedge-shaped spring plate to a desired length, or by grinding one end of a spring plate having a rectangular cross section. FIG. 7 shows another embodiment of the pressure plate 16 which may also be applied to the developing device 11 to attain the intended objectives. In this embodiment, the pressure plate 16 is a combined plate formed by combining three spring plates 16*a*–16*c* which are different in width, $W_1$, $W_2$ and $W_3$, but, preferably, same in other properties. The three plates 16*a*–16*c* are put together, for example, by adhesives such that the combined thickness becomes smaller toward its tip end 17. As a further modification, the pressure plate 16 having a variant deflectability may be fabricated by changing the degree of tempering to be applied to a plate such that its tip end is less tempered than the rest.

Figure 8:
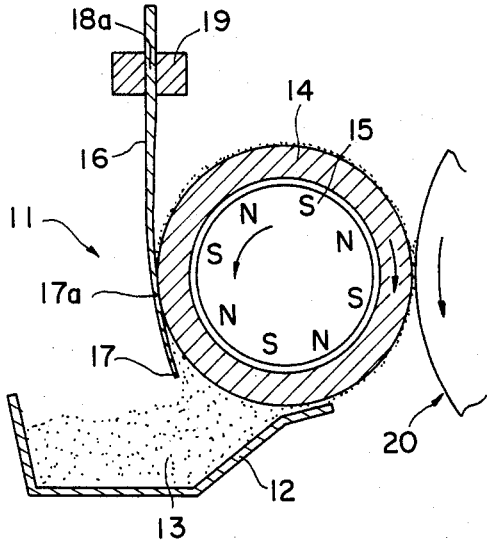
FIGS. 8 through 11 are schematic illustrations showing several embodiments of the present invention having pressure plates constructed in accordance with the principle of increase in deflectability toward the tip end.

FIG. 8 shows a further embodiment of the present developing device 11, in which the pressure plate 16 is disposed such that its tip end 17 is located below the contact point 17*a* between the pressure plate 16 and the developing sleeve 14. Moreover, in the embodiment shown in FIG. 8, the pressure plate 16 is supported by the supporting structure 19 at a location spaced inwardly from its top end. The pressure plate 16 in this case has also a wedge-shaped cross section which is convergent toward the tip end 17.

Figure 9:
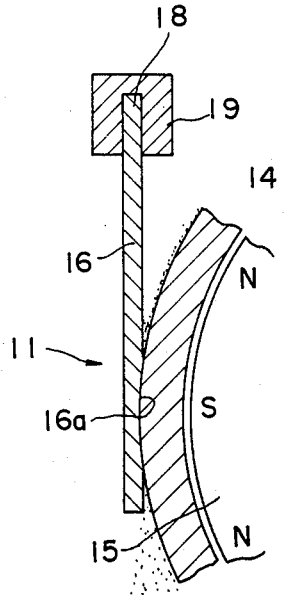
Figure 10:
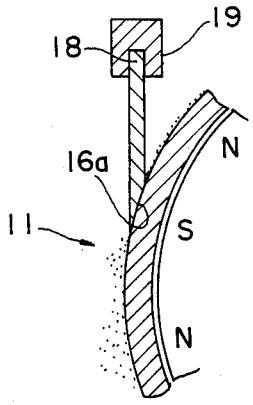
Figure 11:
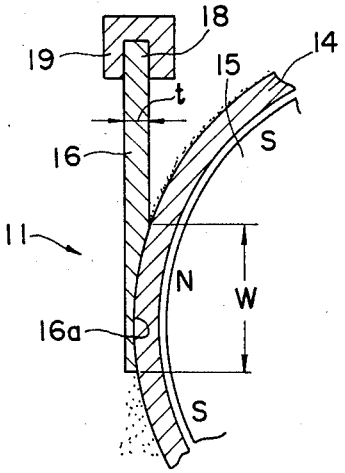

FIGS. 9–11 show several further embodiments of the present developing device 11 which includes the pressure plate 16 having a locally particularly shaped portion. In any of these embodiments, the pressure plate 16 has a contact region 16*a* which is partly recessed or cut in conformity in shape with the peripheral surface of the sleeve 14. Thus, in any of these illustrated examples, the contact region 16*a* is provided as a curved dent or surface with which the sleeve 14 may be partly brought into contact. With such a structure, that portion of the pressure plate 16 which comes into contact with the sleeve 14 is thinner in thickness as compared with the rest, and, thus, the pressure plate 16 is provided with a locally easily deflectable portion. In the embodiment of FIG. 9, such a contact region 16*a* is provided away from the tip end; on the other hand, in the embodiments of FIGS. 10 and 11, the contact region 16*a* is provided adjacent to the tip end of the pressure plate 16. Experiments have been conducted using the developing device 11 having the structure illustrated in FIG. 11 with the sleeve 14 having outer diameter of 30 mm and the pressure plate 16 having thickness t of 0.1 mm and length W of contact region 16*a* of 2–3 mm, and it has been found that the thin film 12*a* of uniformly charged toner particles may be formed stably without any irregularities. It is to be noted that in any of the embodiments described above, the magnet roll 15 is used as a means for keeping the magnetic toner particles on the peripheral surface of the developing sleeve 14; however, other means such as an electromagnet may also be used for such a purpose. Besides, the pressure plate 16 may be entirely or partly comprised of a magnetic material, and, in some cases, the pressure plate 16 may also be made of a non-magnetic material. Moreover, the developing sleeve 14 as a toner carrier in any of the embodiments so far illustrated is comprised of a sleeve, but it may take any other form such as an endless belt without departing from the scope and spirit of the present invention.

Figure 12:
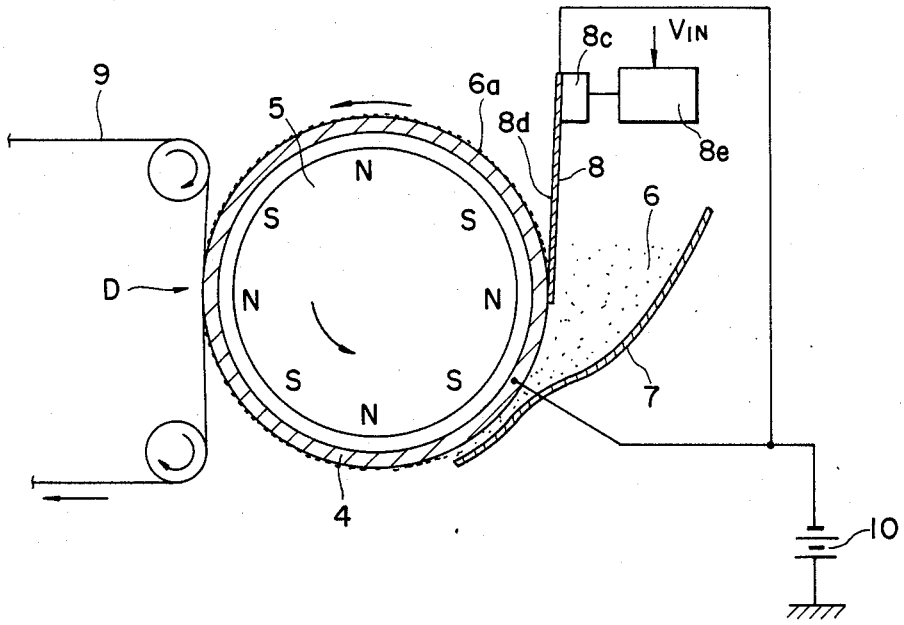
FIG. 12 is a schematic illustration showing a still further embodiment of the present developing device, which includes a vertically movable pressure plate.

FIG. 12 shows a still further embodiment of the present invention. It is to be noted that, as practiced throughout the present specification, like reference numerals and characters are used to indicate like elements and the detailed explanation for each of the like elements appearing in different embodiments will not be given to avoid redundancy. As shown, the developing device shown in FIG. 12 is structurally similar in many respects to the developing device shown in FIG. 2. In the present developing device shown in FIG. 12, the pressure plate 8 is comprised of a magnetic material such as an SK material in the order of 0.1 mm thick, so as to have sufficient resiliency. Also provided is a voltage source 10 which is connected to apply a selected voltage to the pressure plate 8 and the developing sleeve 4 thereby maintaining them at the same potential. In the illustrated embodiment, a negative potential is applied.

Figure 1A:
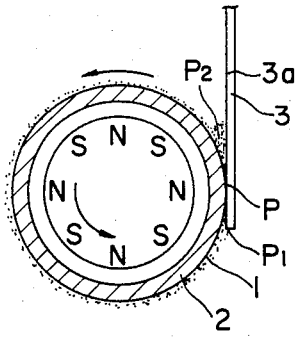
Fig. 1a PRIOR ART
FIGS. 1*a* and 1*b* are schematic illustrations showing a typical prior art developing device.
Figure 1B:
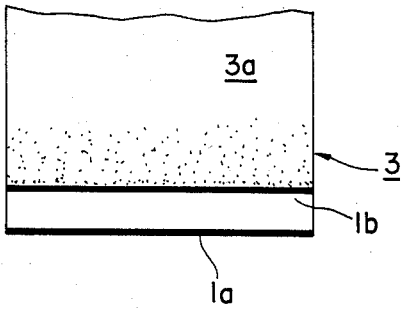
Fig. 1b PRIOR ART

Of importance, the top end of the pressure plate 8 is supported by a supporting structure 8*c* which includes a means for moving the pressure plate 8 vertically along the tangential line defined at the contact between the pressure plate 8 and the sleeve 4. The supporting structure 8*c* is connected to a driving control device 8*e* which is connected to receive a control signal $V_{IN}$ supplied from a signal source (not shown). It is to be noted that the control signal $V_{IN}$ is supplied to the driving control device 8*e* while development of a latent image is not in progress. When the control signal $V_{IN}$ is supplied, the supporting structure 8*c* causes the pressure plate 8 to move up and down with maintaining pressure contact with the sleeve 4 for a predetermined period of time so that a front or contact surface 8*d* of the pressure plate is scrubbed against the sleeve 4 over a range determined by the stroke of the pressure plate 8. In this manner, by causing the pressure plate 8 to scrub against the sleeve 4 during non-development period, the toner particles accumulated on the pressure plate 8 in the form of a ridge, e.g., toner ridges 1*a* and 1*b* shown in FIG. 1*b*, may be completely removed from the pressure plate 8 thereby making the contact surface 8*d* smooth without stuck toner particles. It is to be noted that toner cleaning of the pressure plate 8 in the present embodiment is carried out during non-development period.

Figures 13A, 13B, 13C, 13D:
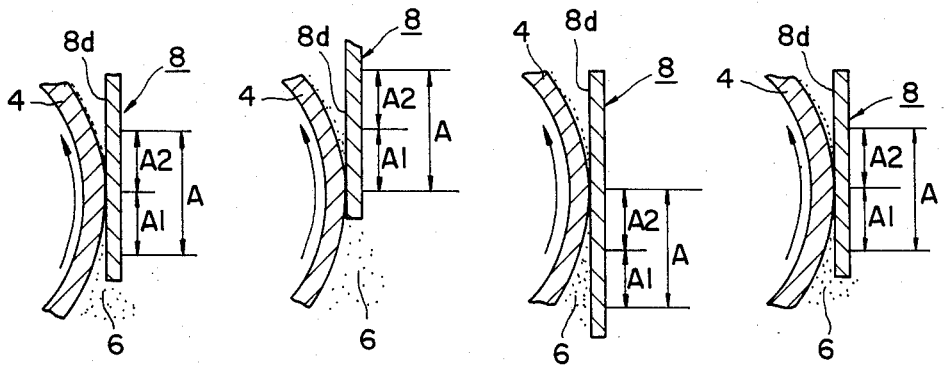
FIGS. 13*a* through 13*d* are schematic illustrations useful for explaining the operation of the structure shown in FIG. 12.

FIGS. 13*a*–13*d* illustrate how the contact surface 8*d* of the pressure plate 8 is cleaned during non-development period. In response to the control signal $V_{IN}$ supplied to the driving control device 8*e*, the supporting structure 8*c* starts to move the pressure plate 8 first upward from the position shown in FIG. 13*a* to the position shown in FIG. 13*b* over a distance A1, which is previously determined to be sufficiently long to remove a ridge of accumulated toner particles which tend to become stuck to the contact surface 8*d*. Then, the pressure plate 8 is moved downward over a distance A, which is a sum of A1 and A2, to take the position indicated in FIG. 13*c*. Here again, the distance A2 is also previously so determined that another ridge of toner particles formed on the contact surface 8*d* in the downstream of the contact between the pressure plate 8 and the sleeve 4 may be completely removed. Then, the pressure plate 8 is moved upward to the original position as shown in FIG. 13*d*. In some applications, however, the step of FIG. 13*c* may be omitted, in which case, the pressure plate 8 is returned to the original position shown in FIG. 13*d* from the raised position shown in FIG. 13*b*. In this case, the region over the distance A1 is not subjected to scrubbing operation; however, it is usually more important to keep the region A2 as smooth as possible in the formation of a thin film of toner particles uniform in thickness as well as in charge.

Figure 14:
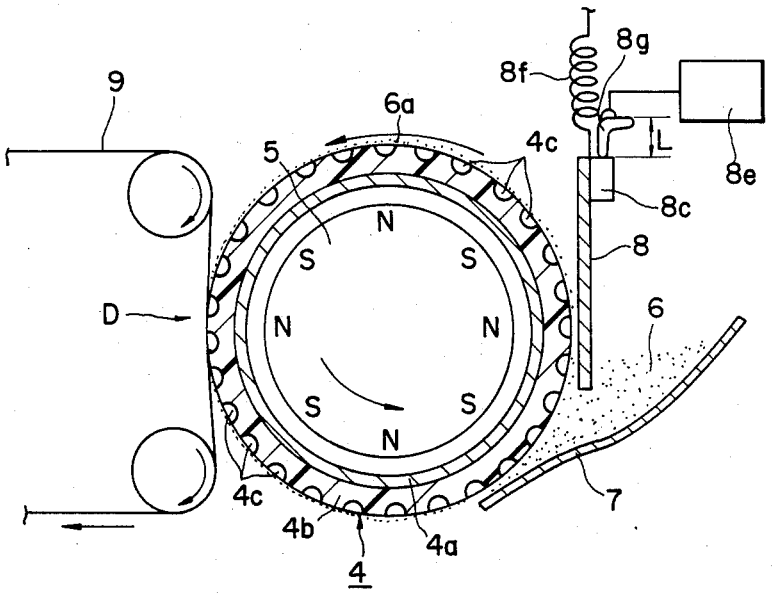
FIG. 14 is a schematic illustration showing a modification of the structure shown in FIG. 12.
Figure 15B:
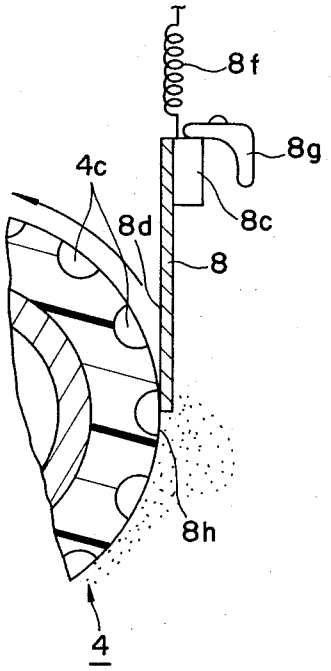
FIGS. 15*a* and 15*b* are schematic illustrations useful for understanding the operation of the structure shown in FIG. 14.
Figure 15A:
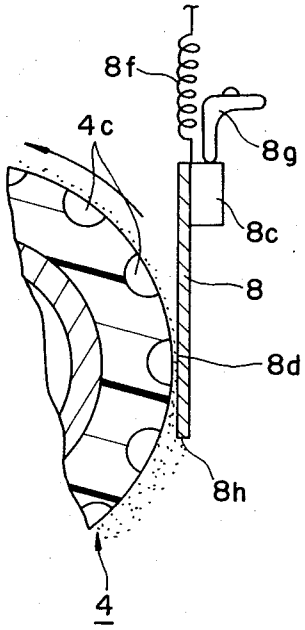

FIGS. 14, 15*a* and 15*b* show a developing device constructed in accordance with a still another embodiment of the present invention. As shown in FIG. 14, this embodiment comprises a composite developing sleeve 4 which includes a cylindrical base 4*a* of an electrically conductive material, a dielectric layer 4*b* of a dielectric material such as epoxy resin and polyester resin formed on the outer peripheral surface of the cylindrical base 4*a* approximately to the thickness of 600 microns and a number of fine floating electrodes 4*c* which are scattered in the dielectric layer 4*b*, are partly exposed at the outer peripheral surface of the dielectric layer 4*b* and are electrically insulated from one another. The floating fine electrodes are comprised of a metal such as copper and they originally have the average diameter of about 80 microns. For example, the dielectric layer 4*b* is formed on the outer peripheral surface of the cylindrical base 4*a* with a number of copper beads embedded therein, and, thereafter, the outer surface of the dielectric layer 4*b* is ground to have the embedded copper beads exposed at the ground surface. Preferably, the copper beads are previously coated with an insulating material. In the present embodiment, the composite sleeve 4 and the magnet roll 5 disposed inside of the sleeve 4 are driven to rotate in the same direction, though the direction of rotation for each may be selectively determined. As an example, the sleeve 4 may be advantageously driven to rotate at the peripheral speed of approximately 500 mm/sec and the magnet roll 5 at about 1,800 r.p.m.

As shown in FIG. 14, the pressure plate 8 is mounted to be pressed against the developing sleeve 4 and its top end is fixedly attached to the supporting member 8*c*, which, in turn, is in operative engagement with a cam 8g and is also connected to one end of a spring 8f whose other end is fixedly attached, for example, to the housing (not shown) of the developing device. The cam 8g is arranged to pivot under the control of the driving control device 8e, which receives a control signal from a controller in charge of control of the overall image forming process. The pressure plate 8 is normally biased upward by means of the spring 8f so that the supporting member 8c is always forced into abutment against the cam 8g. Accordingly, as the cam 8g is pivoted, the pressure plate 8 is forced to move up and down as illustrated in FIGS. 15a and 15b, so that the toner particles sticking to the contact surface of the pressure plate 8 may be removed due to scrubbing action between the pressure plate 8 and the sleeve 4.

In the preferred mode, the pressure plate 8 is held in the lowered position shown in FIG. 15a during developing operation; whereas, during non-developing operation, the pressure plate 8 is moved to the raised position shown in FIG. 15b so as to locate its tip end 8h pressed against the sleeve 4 while keeping the sleeve 4 in rotation, to thereby peel off any toner film formed on the peripheral surface of the sleeve 4 by the tip end 8h. It is to be noted that the pressure plate 8 may be moved to the raised position shown in FIG. 15b after every single copying operation or after every predetermined number of copying operations. Alternatively, or in addition, such a cleaning operation may be carried out immediately after power up or prior to initiation of any copying operation. It is to be noted that the principle of this embodiment is also applicable to the developing device which includes a single-layered developing sleeve 4 as shown in previous embodiments.

Figure 17:
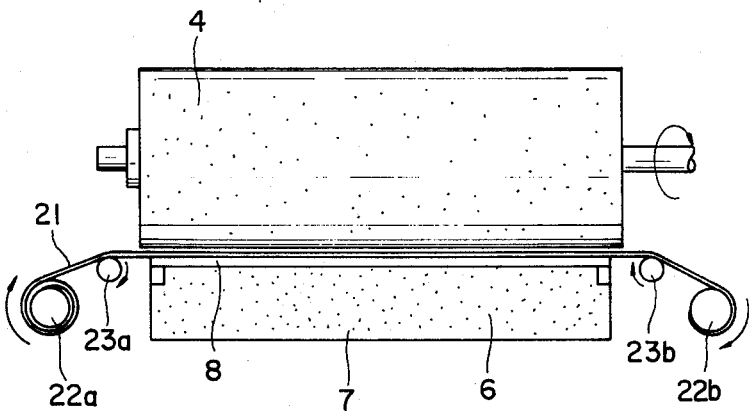
FIG. 17 is a plan view showing the overall structure of FIG. 16.
Figure 18:
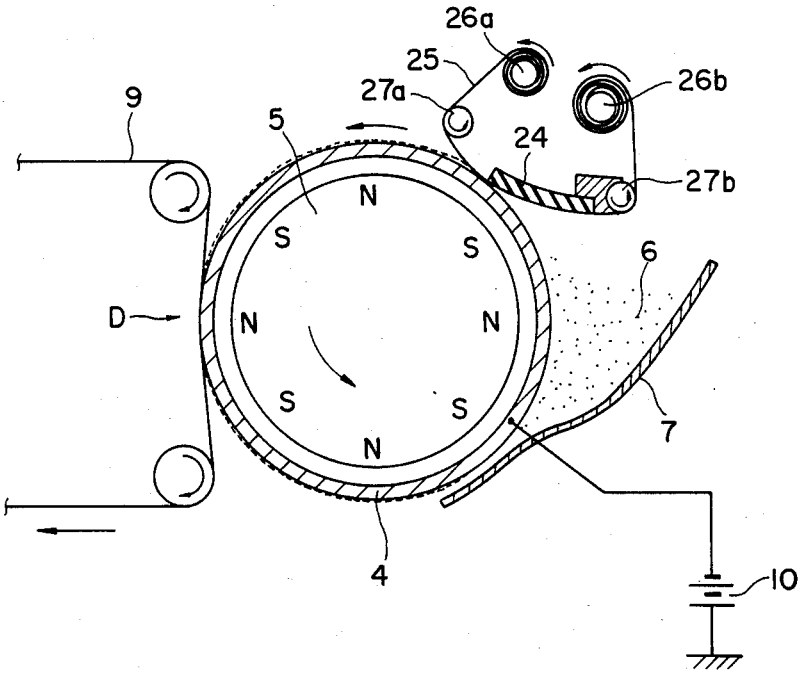
FIG. 18 is a schematic illustration showing a modification of the structure shown in FIG. 16.

FIGS. 16–18 show still further embodiments of the present invention. The developing device shown in FIGS. 16 and 17 is provided with a separator strip 21 interposed between the pressure plate 8 and the sleeve 4. As shown in FIG. 17, the separator strip 21 is extended between a supply roll 22a and a take-up roll 22b, and is guided by a pair of guide rollers 23a and 23b which are disposed adjacent to the end surfaces of the sleeve 4. The take-up roll 22b is driven to rotate intermittently in the direction indicated by the arrow thereby causing the separator strip 21 to advance in the axial direction of the sleeve 4 over a predetermined length which is preferably substantially equal to the length of the sleeve 4 in the axial direction. The separator strip 21 is comprised of a selected material having the property of excellent separability with respect to the toner particles 6 used, such as polyester. As a result, the pressure plate 8 in the present embodiment is not in direct contact with the sleeve 4 as a toner carrier, but the separator strip 21 is pressed against the sleeve 4. With such a structure, the pressure plate 8 is prevented from being worn and the contact surface of the separator strip 21 which is pressed against the sleeve 4 may be kept smooth without stuck toner particles because the separator strip 21 is moved intermittently. Moreover, in the preferred embodiment, the surface of the separator strip 21 which faces the sleeve 4 is provided with an electrically conductive layer such as vacuum-deposited aluminum, and the conductive layer is maintained at the same potential as that of the sleeve 4, for example, by connecting to a D.C. voltage source. This structure is preferred because the charge accumulated due to friction may be removed.

FIG. 18 shows a modification of the embodiment shown in FIGS. 16 and 17. In the developing device shown in FIG. 18, instead of the magnetic pressure plate 8 provided in the embodiment shown in FIGS. 16 and 17, an elastic pressure plate 24 of polyurethane is provided. A separator strip 24 is extended between a supply roll 26a and a take-up roll 26b, and is guided by a pair of guide rollers 27a and 27b such that it may move in the direction opposite to the moving direction of the sleeve 4 at the contact therebetween. The separator strip 25 is locally kept in pressure contact with the sleeve 4 as pressed by the tip end of the elastic pressure plate 24. It is to be noted that the separator strip 25 has a width which is substantially equal to the width of the sleeve 4 and has a property of excellent separability with respect to the toner particles 6 used. The separator strip 25 may be advanced continuously or intermittently. In the present embodiment, the D.C. voltage source 10 is only connected between the sleeve 4 and ground.

Figure 19:
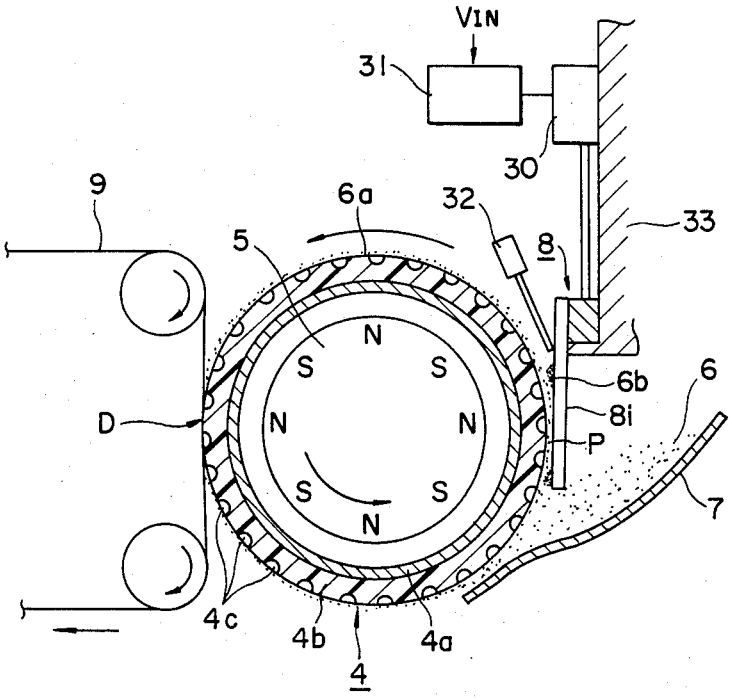
FIGS. 19 through 21 are schematic illustrations showing several embodiments of the present developing device having a stationary cleaning member 32.
Figure 20A:
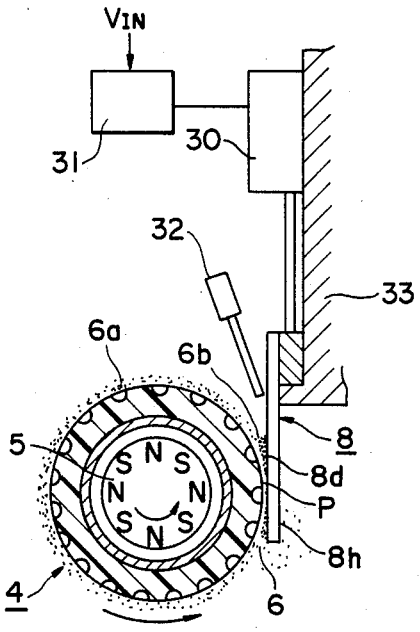
Figure 20B:
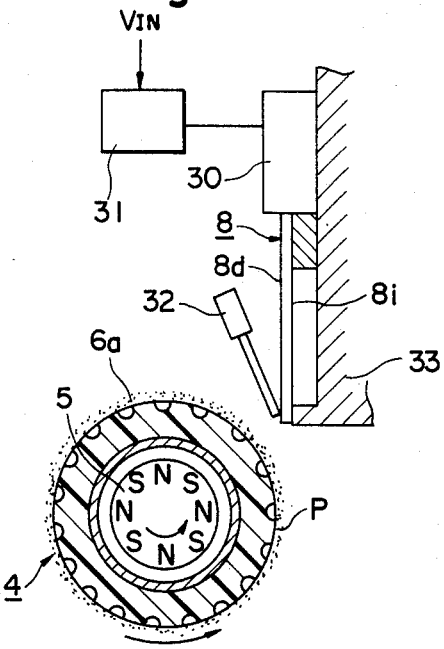
Figure 21:
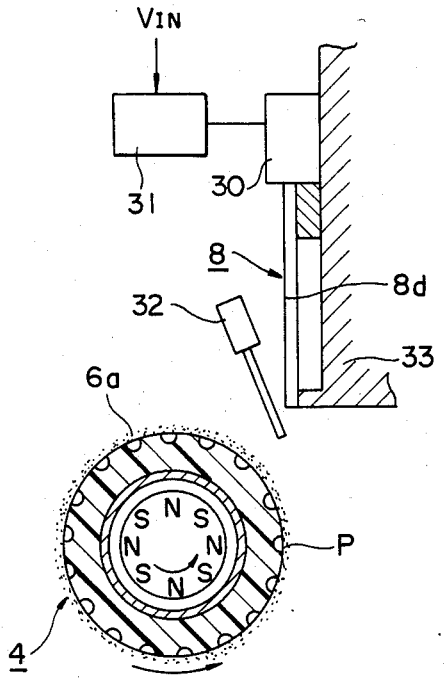

FIGS. 19–21 show a still further embodiment of the present invention in which a stationary plate cleaner is provided for keeping the contact surface of the pressure plate smooth at all times. As shown in FIG. 19, the developing device of the present embodiment comprises the composite developing sleeve 4 as described previously, and in pressure contact with the sleeve 4 is provided the magnetic pressure plate 8 with its free end located below the contact point between the pressure plate 8 and the sleeve 4. The pressure plate 8 is operatively connected to a driving mechanism 30, such as an electromagnetic solenoid or cylinder actuator, which, in turn, is connected to a driving control device 31 to which a control signal $V_{IN}$ is supplied from a main controller (not shown) in charge of the overall process control. The driving mechanism 30 is fixedly mounted on a guide wall 33 which is provided with a projection at its bottom. The pressure plate 8 has its contact surface 8d facing the sleeve 4 and its rear surface 8i in sliding contact with the projection of the guide wall 33. Also provided fixed in position is a blade cleaner 32 with its bottom end located closer to the projection of the guide wall 33 such that the pressure plate 8 is slidingly held under pressure between the bottom end of the blade cleaner 32 and the projection of the guide wall 33. As a result, when the pressure plate 8 is moved as pressed between the cleaner 32 and the guide wall 33, any toner particles or other materials sticking to the surfaces of the pressure plate 8 may be completely removed.

FIG. 20a shows the pressure plate 8 set in operative or lowered position. The pressure plate 8 is in pressure contact with the sleeve 4 and, as the sleeve 4 rotates, a thin film 6a of uniformly charged toner particles may be formed on the peripheral surface of the sleeve 4 and used in developing an electrostatic latent image carried on the belt 9 at the developing station D. As the operation proceeds, toner particles start to accumulate on the contact surface 8d to form a small heap 6b. Thus accumulated toner particles 6b will eventually become strongly stuck to the contact surface 8d thereby hindering the stable formation of a thin toner film 6a of uniform thickness and charge. Thus, upon completion of a predetermined number of copying cycles, the control signal $V_{IN}$ is supplied, and the solenoid 30 is energized to pull the pressure plate 8 upward to the position indicated in FIG. 20b. During this upward movement, the contact surface 8d is scrubbed by the bottom edge of blade cleaner 32 so that the accumulated toner particles 6b may be completely removed. Thereafter, prior to the following copying operation, the solenoid 30 is again deenergized to have the pressure plate 8 returned to the original operative position shown in FIG. 20*a*.

FIG. 21 shows a modification of the developing device shown in FIGS. 19–20*b*, and in the embodiment of FIG. 21, the blade cleaner 32 is disposed with its bottom end located slightly below the supporting projection of the guide wall 33. Such an arrangement insures complete removal of sticking toner particles from the pressure plate 8.

Figure 22:
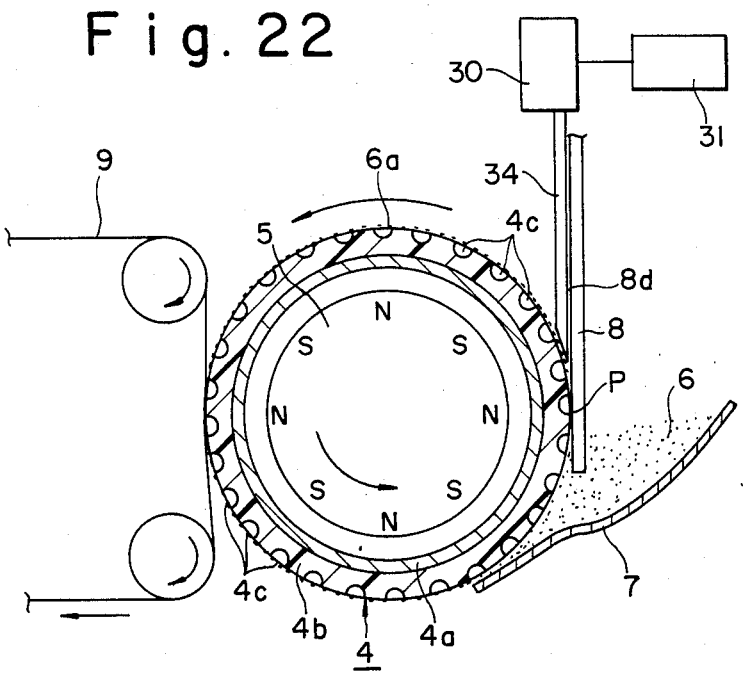
FIGS. 22 through 26*b* are schematics showing several embodiments of the present developing device having a movable cleaning member 34.

FIGS. 22–26*b* show several further embodiments of the present invention in which provision is made of a movable cleaner for cleaning the contact surface of the stationarily provided pressure plate 8. As shown in FIG. 22, the developing device of this embodiment includes a movable blade cleaner 34 which is preferably comprised of a non-magnetic material. The blade cleaner 34 is operatively connected to the driving mechanism 30 and has a knife-edged bottom end which may slide along the contact surface 8*d* of the pressure plate 8 when driven to move. It is to be noted that the blade cleaner 34 of this embodiment can take the raised position shown in FIG. 23*a* and the lowered position shown in FIG. 23*b*, where the tip end of the movable blade cleaner 34 is at or in the vicinity, preferably in the downstream side, of the contact between the pressure plate 8 and the sleeve 4. Such being the case, the movable blade cleaner 34 may be set in cleaning operation at any desired time, whether during development period or during non-development period. It is to be noted that the present embodiment is mainly for removal of the heap 6*b* of toner particles accumulated in the downstream side of the contact P between the pressure plate 8 and the sleeve 4 during operation, because it has been found empirically that, in most cases, periodic removal of the accumulated toner particles 6*b* in the downstream side of contact P between the pressure plate 8 and the sleeve 4 is sufficient in maintaining the formation of a desired toner film 6*a* from a practical viewpoint.

Figure 23A:
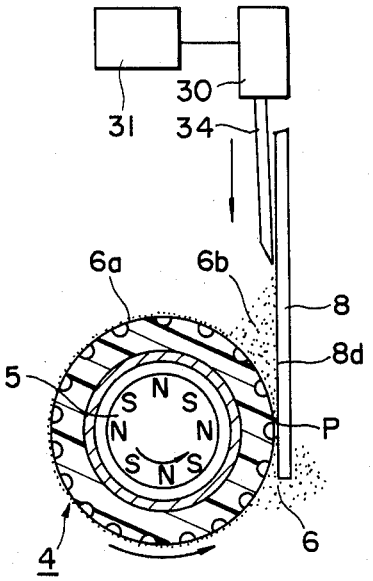
Figure 23B:
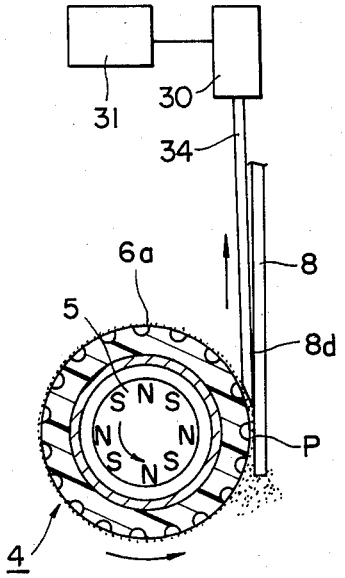
Figure 24:
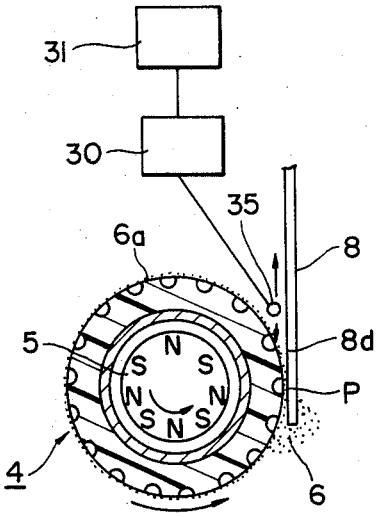

FIG. 24 shows a modification of the developing device shown in FIGS. 22–23*b*, and, as shown, in the developing device of FIG. 24 a rod or wire cleaner 35 is used instead of the blade cleaner 34. The cleaner 35 is also preferably comprised of a non-magnetic material, and it is moved along the contact surface 8*d* between the raised position and the lowered position which is the contact point P or its vicinity.

Figure 25:
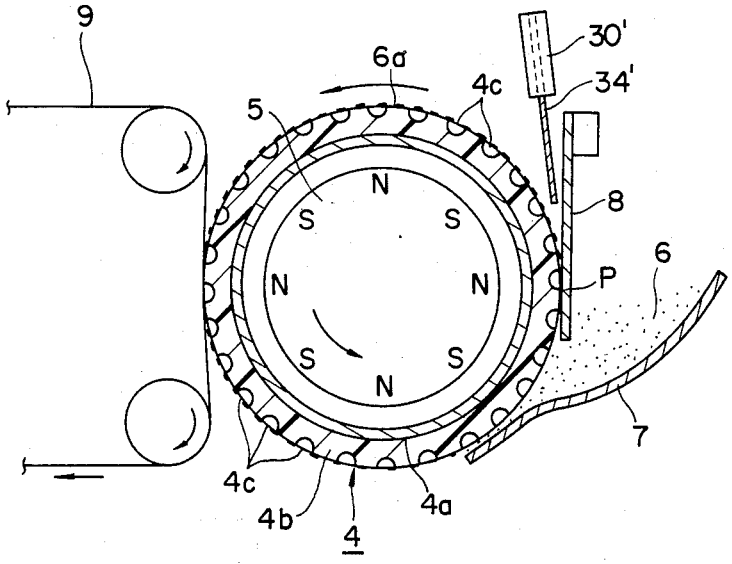
Figure 26A:
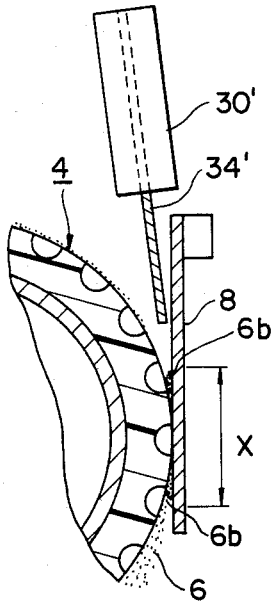
Figure 26B:
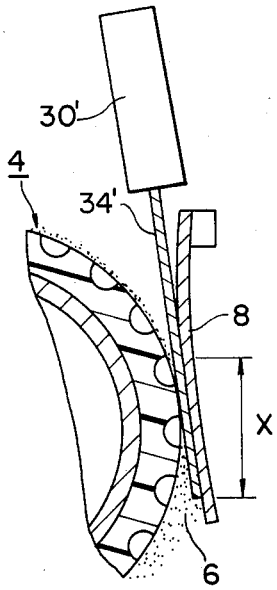

FIGS. 25–26*b* show another modification of the developing device including a movable blade cleaner. As shown, there is provided a movable blade cleaner 34' which is disposed slightly inclined with respect to the pressure plate 8 such that its bottom end is pointed toward the contact point P between the pressure plate 8 and the sleeve 4. As shown in FIGS. 26*a* and 26*b*, the blade cleaner 34' slides along the contact surface of the pressure plate 8 over a predetermined distance X when extended. The tip end of the blade cleaner 34' extends substantially beyond the contact point P so that the toner particles 6*b* accumulated on the pressure plate 8 both downstream and upstream of the contact point P may be removed. FIG. 26*a* shows the condition when the blade cleaner 34' is retracted, and it is to be noted that the blade cleaner 34' is slightly inclined with respect to the pressure plate 8. Such an angular arrangement allows to keep the blade cleaner 34' and the pressure plate 8 in contact over the distance X when the blade cleaner 34' is extended.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image formed on an image bearing member at a developing station, comprising:

transporting means for transporting developer as carried thereon along a predetermined path and past said developing station;

supply means for supplying said developer to said transporting means; and regulating means disposed downstream of said supply means for regulating the supply of said developer to said transporting means to thereby form a thin film of charged developer on said transporting means, said regulating means including a pressure plate having an easily deflectable portion which is in pressure contact with said transporting means for forming said thin film of charged developer;

wherein said pressure plate has a free end extending, at said pressure contact, in a direction opposite to that of said path;

wherein said easily deflectable portion is defined by a reduced thickness region; and wherein said pressure plate has a composite structure in which a plurality of spring plates having differing widths are integrally overlaid on top of another such that their bottom ends terminate short of the next one.

2. A device for developing an electrostatic latent image formed on an image bearing member at a developing station, comprising:

transporting means for transporting developer as carried thereon along a predetermined path and past said developing station;

supply means for supplying said developer to said transporting means; and regulating means disposed downstream of said supply means for regulating the supply of said developer to said transporting means to thereby form a thin film of charged developer on said transporting means, said regulating means including a pressure plate having an easily deflectable portion which is in pressure contact with said transporting means for forming said thin film of charged developer;

wherein said pressure plate has a free end extending, at said pressure contact, in a direction opposite to that of said path; and wherein said easily deflectable portion is defined by a region having a reduced spring constant.

3. A device as in claim 2 wherein said region having a reduced spring constant is formed as a less tempered region.

4. A device for developing an electrostatic latent image formed on an image bearing member at a developing station, comprising:

transporting means for transporting developer as carried thereon along a predetermined path and past said developing station;

supply means for supplying said developer to said transporting means;

regulating means disposed downstream of said supply means and pressed against said transporting means for regulating the supply of said developer to said transporting means to thereby form a thin film of charged developer on said transporting means; and cleaning means for cleaning said regulating means to thereby prevent said developer from being permanently stuck to said regulating means;

wherein said developer is carried in a selected direction relative to said regulating means, and said regulating means extends in a direction opposite said selected direction;

further comprising first position control means for moving said regulating means between first and second positions with respect to said transporting means, wherein said cleaning means is fixed in position and partly in contact with said regulating means, so that developer sticking to said regulating means is scrubbed and removed by said cleaning means when the regulating means is moved between said first and second positions.

5. A device for developing an electrostatic latent image formed on an image bearing member at a developing station, comprising:

transporting means for transporting developer as carried thereon along a predetermined path and past said developing station;

supply means for supplying said developer to said transporting means;

regulating means disposed downstream of said supply means and pressed against said transporting means for regulating the supply of said developer to said transporting means to thereby form a thin film of charged developer on said transporting means; and cleaning means for cleaning said regulating means to thereby prevent said developer from being permanently stuck to said regulating means;

wherein said developer is carried in a selected direction relative to said regulating means, and said regulating means extends in a direction opposite said selected direction;

further comprising second position control means for moving said cleaning means between first and second positions with respect to said regulating means so that developer sticking to said regulating means is scrubbed and removed by said cleaning means when the cleaning means is moved between its first and second positions.

* * * * *